US006804919B2

(12) United States Patent
Railkar

(10) Patent No.: US 6,804,919 B2
(45) Date of Patent: Oct. 19, 2004

(54) BACKER FOR TABBED COMPOSITE SHINGLES

(75) Inventor: Sudhir Railkar, Clifton, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 102 days.

(21) Appl. No.: 10/252,950

(22) Filed: Sep. 23, 2002

(65) Prior Publication Data

US 2004/0055241 A1 Mar. 25, 2004

(51) Int. Cl.[7] ..... E04D 1/28

(52) U.S. Cl. ..... 52/105; 52/314; 52/52; 52/555; 52/557; 52/478.1; 52/745.19; 83/920; 83/428; 83/77; 83/141

(58) Field of Search ..... 52/314, 748.1, 52/745.19, 557, 555, 559, 105; 83/920; 428/77, 141; D25/139, 149, 157

(56) References Cited

U.S. PATENT DOCUMENTS

| | | | | | |
|---|---|---|---|---|---|
| 15,280 | A | * | 7/1856 | Abraham | 418/153 |
| 1,412,295 | A | * | 4/1922 | Speer | 52/559 |
| 1,475,551 | A | * | 11/1923 | Overbury | 83/41 |
| 1,846,635 | A | * | 2/1932 | Finley | 83/56 |
| 2,144,678 | A | * | 1/1939 | Goldschmidt, Sr. | 52/559 |
| 2,205,679 | A | * | 6/1940 | Ames, Jr. | 52/554 |
| 2,487,593 | A | * | 11/1949 | Rowe | 52/105 |
| 2,571,057 | A | * | 10/1951 | Patterson | 52/559 |
| 3,407,557 | A | * | 10/1968 | Shaw | 52/555 |
| 3,927,501 | A | * | 12/1975 | Allen et al. | 52/555 |
| 4,233,100 | A | * | 11/1980 | Cunningham et al. | 156/260 |
| D282,287 | S | * | 1/1986 | McKeagan et al. | D25/80 |
| 4,869,942 | A | * | 9/1989 | Jennus et al. | 428/77 |
| 6,010,589 | A | * | 1/2000 | Stahl et al. | 156/260 |
| 6,038,826 | A | * | 3/2000 | Stahl et al. | 52/554 |

* cited by examiner

*Primary Examiner*—Robert Canfield
(74) *Attorney, Agent, or Firm*—Marilyn J. Maue; William J. Davis

(57) ABSTRACT

In a rectangular composite shingle unit including (a) a top sheet having a lower butt portion which is longitudinally divided into spaced tabs and an upper undivided headlap portion having a horizontal line of markings immediately above the butt portion indicating nailable sites for attachment of the shingle unit to a roof deck and (b) a continuous, elongated backer strip underlying the tabs and nail markings of the headlap which is aligned in offset or flush position along the longitudinal margin of the butt portion and which extends from the bottom edges of the tabs to the top area of the nail line markings; the improvement which comprises a backer strip having a plurality of extended projections on the top longitudinal margin of said backer which projections are spaced apart and vertically extend upwardly beyond the nail line markings and underlay the headlap portion of the top sheet.

15 Claims, 6 Drawing Sheets

BACKER FOR TABBED COMPOSITE SHINGLES

FIELD OF THE INVENTION

This invention relates to composite tabbed shingles including an improved underlying backer strip having an extended nailing area for more secure attachment of the shingle unit to a roof deck.

BACKGROUND OF THE INVENTION

A major impediment to permanent shingle placement resides in the failure of attachment to the roof deck. Commercially, the attachment of shingle units to a deck is accomplished with a hand held nailing gun which rapidly ejects nails for penetration through the shingle membrane and underlaying substrate. However, because of the limited area of markings, the rapid feed of nails from the nail gun and the need for precise positioning of the gun over the nail line markings, many of the attachment sites are missed so that the nail passes above the area where the backer underlays the headlap and engages only the headlap portion of the multi-membrane shingle to the roof deck. This results in excessive stress at the point of nail penetration and eventual displacement of the shingle unit.

One solution to this problem suggests the substitution of a backer strip having the same width as the top sheet. However, this solution is found to be impractical since the weight of the unit is greatly increased causing problems in packaging, handling and installation. Additionally, many more nails are required to carry the weight of the shingle.

Accordingly it is an object of this invention to overcome the above problems and avoid single membrane misses causing shingle displacement by means of a commercially feasible improvement in the configuration of the backer strip.

Another object is to provide component portions of a composite tabbed shingle including the improved backer strip which can be produced in a single, economical cutting operation.

Still another object is to provide a shingle with a wider area of attachment sites which eliminates the need for precise placement of nails in order to penetrate all of the shingle membranes without materially adding to the weight of the unit.

Yet another object is to provide a nailing area which accommodates a variety of nailing patterns and which may conserve the number of nails required for secure and permanent shingle attachment.

Another object is to provide shingle units which are conveniently packaged in a nesting position with regard to the laminated backer strips.

These and other objects and advantages will become apparent from the following description and disclosure.

SUMMARY OF THE INVENTION

In a tabbed composite roofing shingle, the present invention concerns an improved underlying backer strip having a plurality of spaced, vertically extending projections along its top margin to provide a significantly wider nailing area for engaging and attaching all components of a laminated composite shingle to a roof deck.

BRIEF DESCRIPTION OF THE DRAWINGS

The drawings illustrate embodiments of the present backer components, positioning of the backer in a tabbed composite shingle unit and a modified cutting pattern to provide simultaneous production of a matching pair of shingle units. However, it will be understood that this invention is not limited to the precise arrangements or designs shown in the drawings.

DETAILED DESCRIPTION OF THE INVENTION

Figure 1:
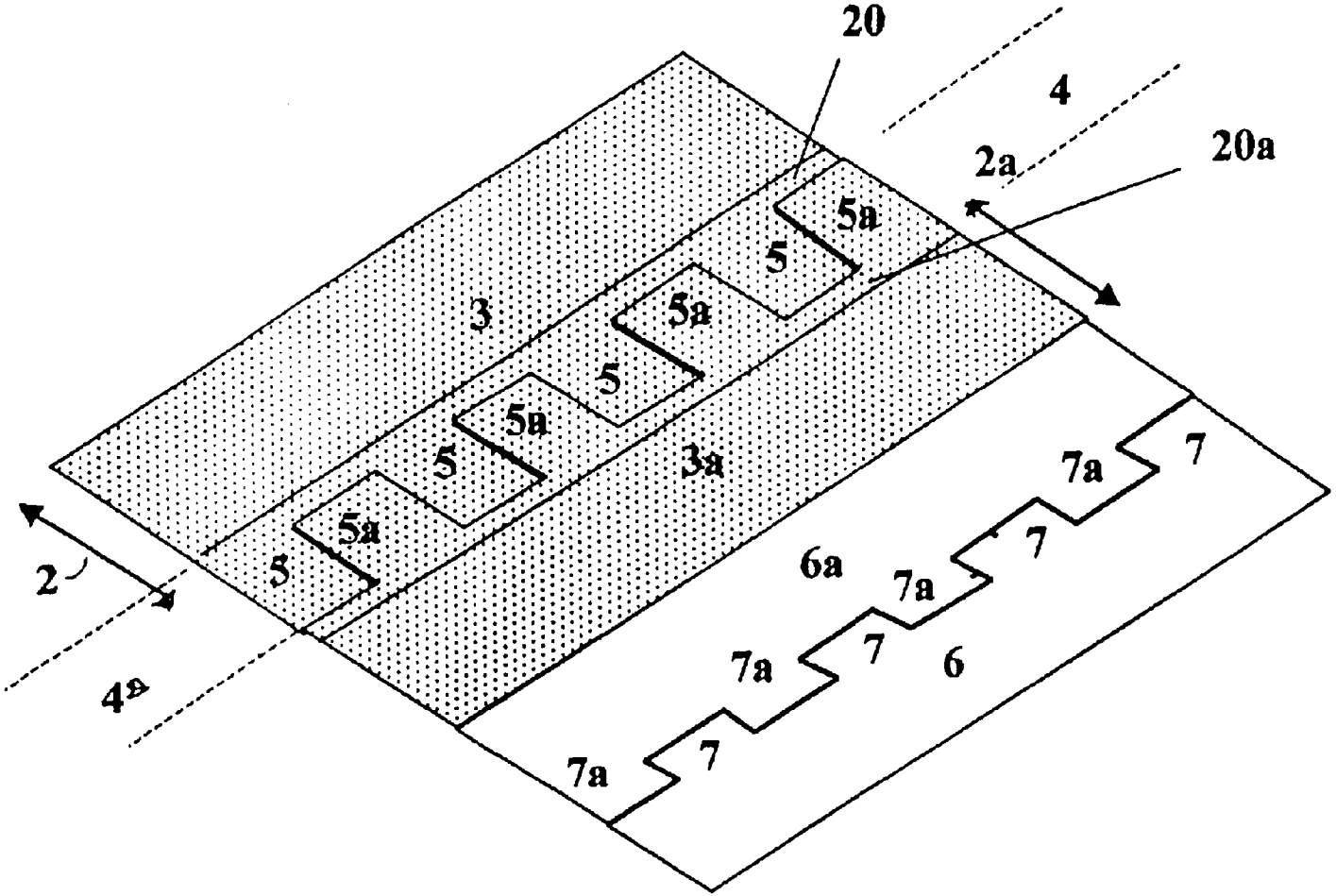
FIG. 1 is a perspective view of a pair of matching elongated shingle top sheets and backer strips presented for simultaneous cutting into component parts of two units of the present composite shingle.

In accordance with FIG. 1, a length of shingle material is coded for simultaneously cutting a mirror imaged pair of shingle units comprising dimensionally matching top sheets 2 and 2*a* having headlap portions 3 and 3*a* and butt portions 4 and 4*a* each butt portion contains a plurality of spaced tabs 5 and 5*a*. Additionally, each top sheet carries nailing indicia 20 and 20*a* horizontally disposed across top sheet members 2 and 2*a* and located above said tabs.

Figure 1A:
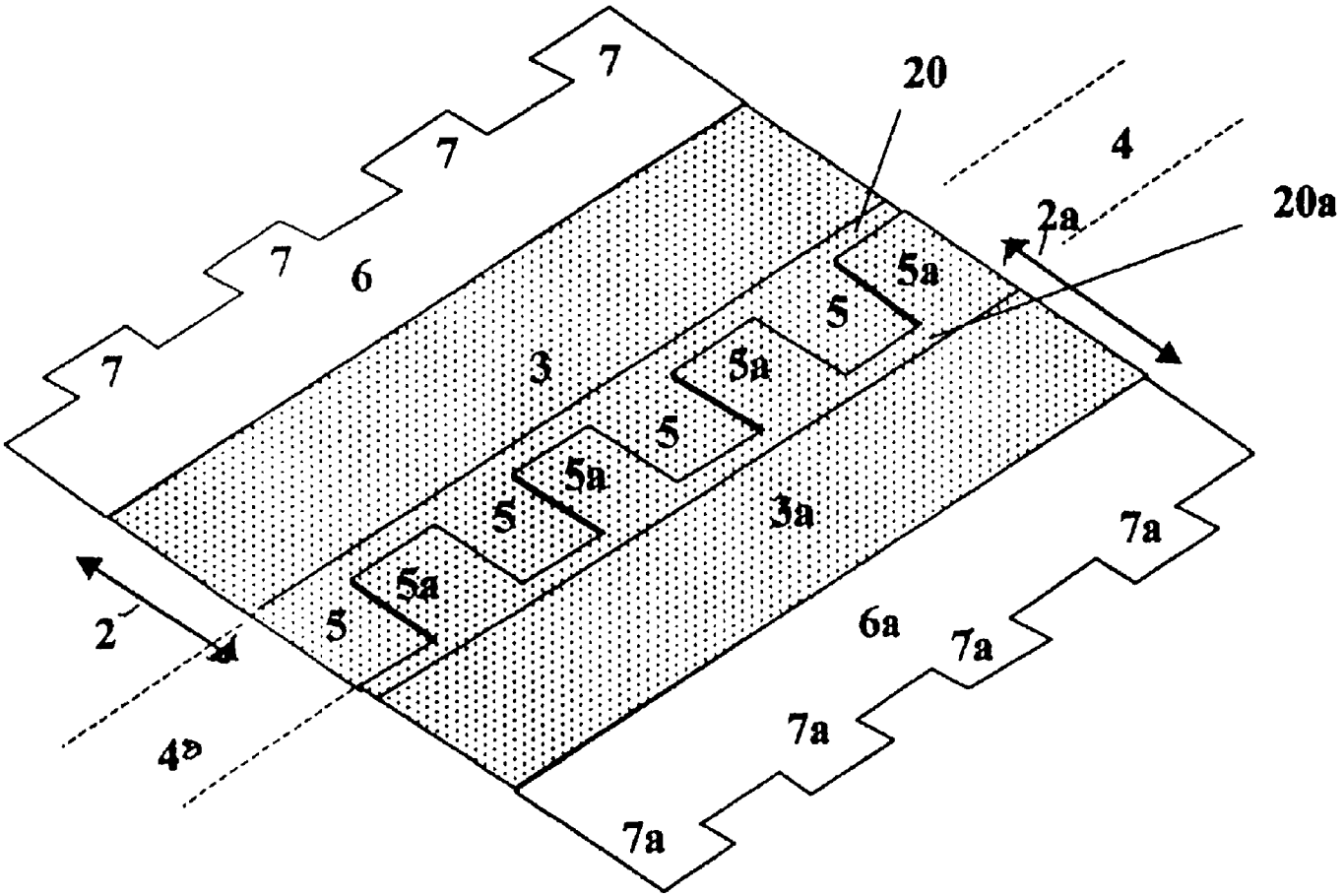
FIG. 1*a* is a variation of FIG. 1 showing an alternative cutting pattern for a matching pair of elongated shingle sheets and backer strips presented for simultaneous cutting into component parts of the present composite shingle units, shown in perspective.

The top or bottom horizontal edge margin of top sheet 2 or 2*a* is additionally coded in a pattern designed to provide a mirror imaged pair of backer sheets, 6 and 6*a*, so as to simultaneously produce of all components required for the pair of composite shingle units in an economical and single cutting operation. In this embodiment, the cutting pattern of backer sheets 6 and 6*a* each are designed to have their spaced projections, 7 and 7*a*, in abutting relationship. Alternatively, as shown in FIG. 1*a*, the top margins of each top sheet headlap can be individually coded to cut separate backer strips at opposite sides of the roofing membrane so that the mirror imaged projections 7 and 7*a* face outwardly from cutting surface of the membrane. In still another embodiment, the top sheet and the present backer can be produced separately. In the later case, the projections on each of the backer strips of the pair can have a different configuration.

Figure 2:
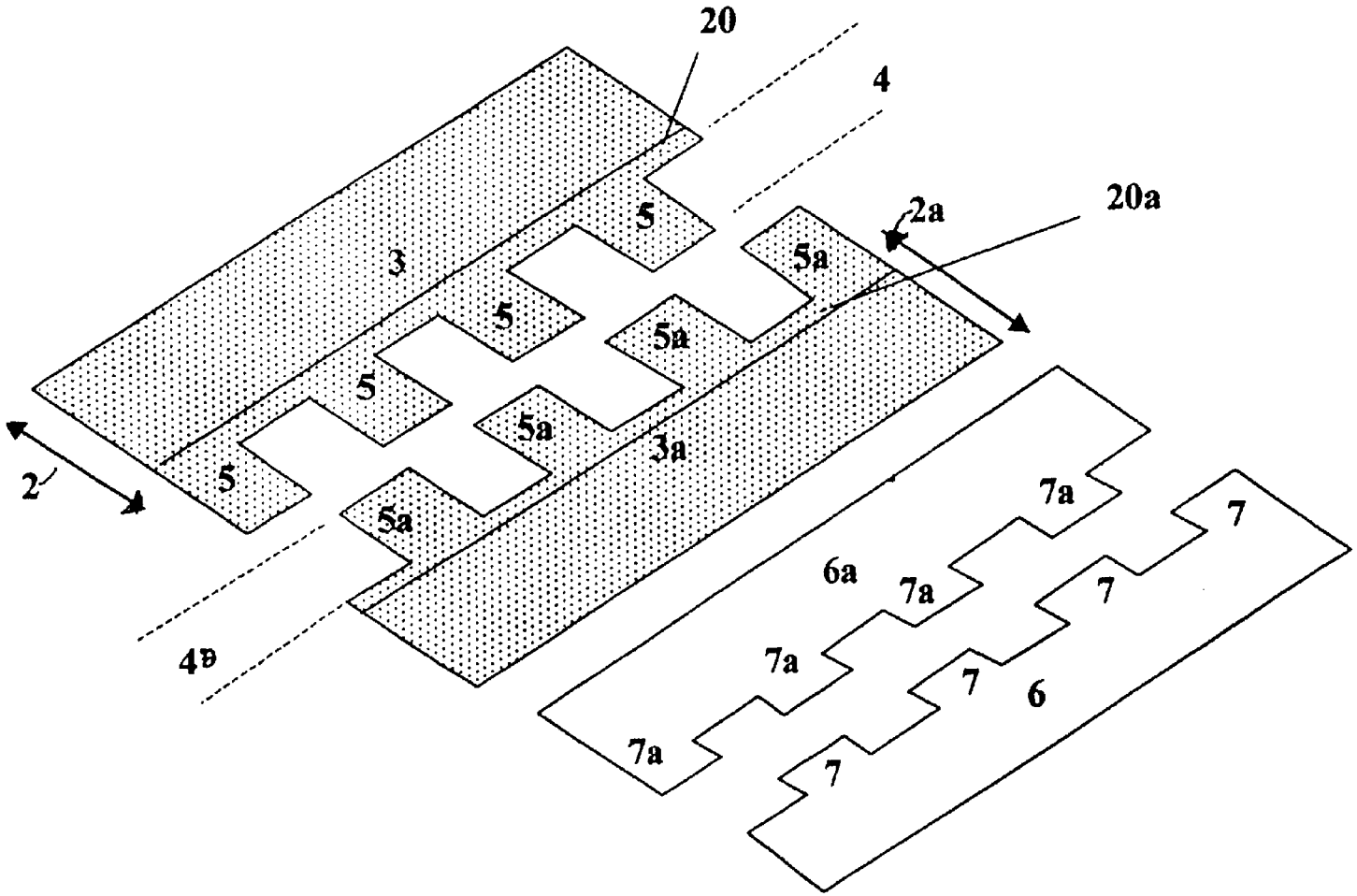
FIG. 2 is a perspective view of the separated top sheet portions and backer portions obtained in the above single cutting operation.

FIG. 2 shows separation of the shingle components 2/6 and 2*a*/6*a* of FIG. 1 after cutting prior to assembly.

Figure 3:
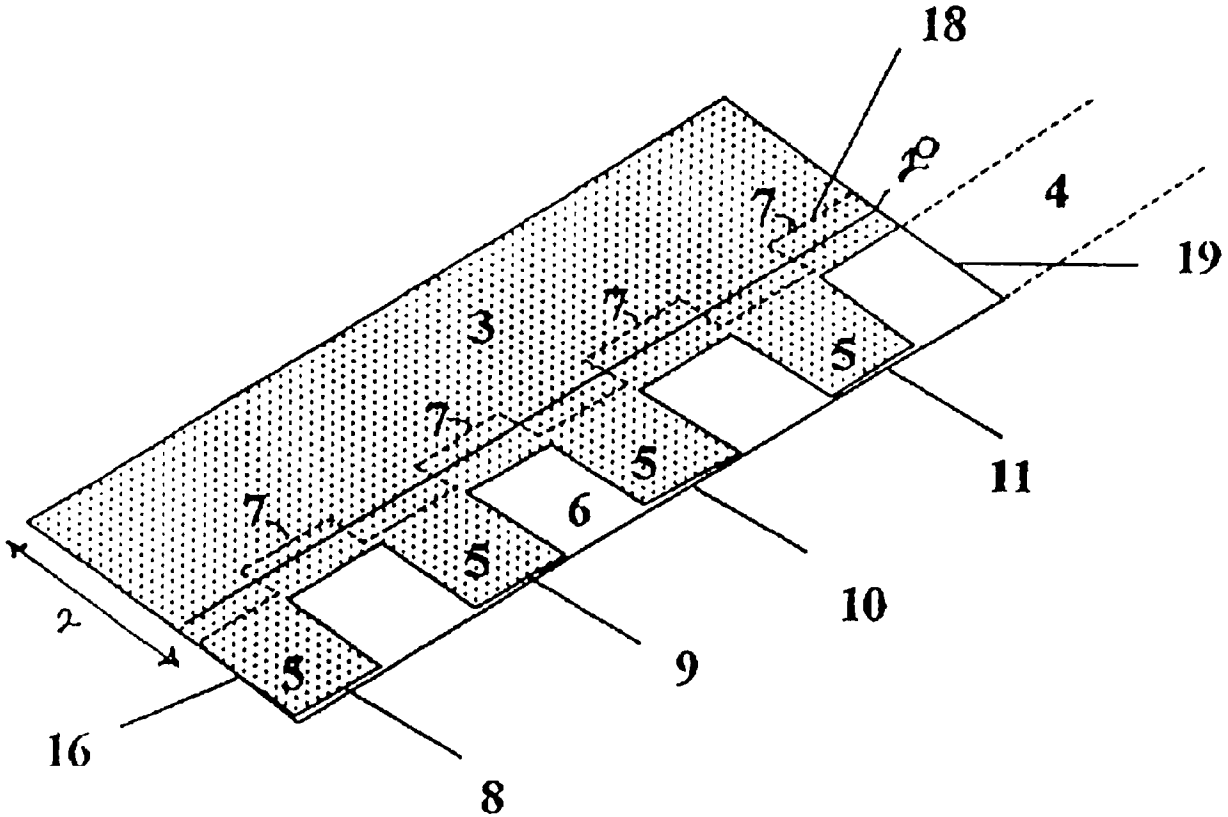
FIG. 3 is a perspective view of the assembled shingle unit involving FIGS. 1 and 2.
Figure 5:
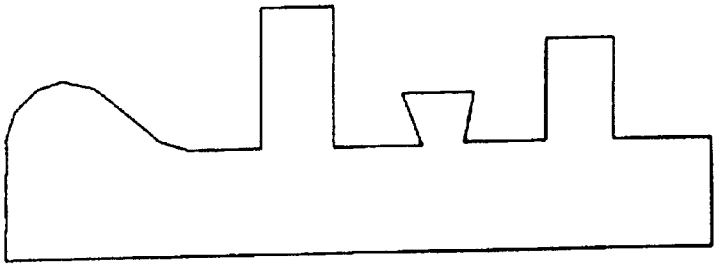
FIGS. 4 through 9 are top views of individual embodiments of the present improved backer strip having spaced extended projections on its upper margin, which backers are suitably mounted under a tabbed top sheet.
Figure 7:
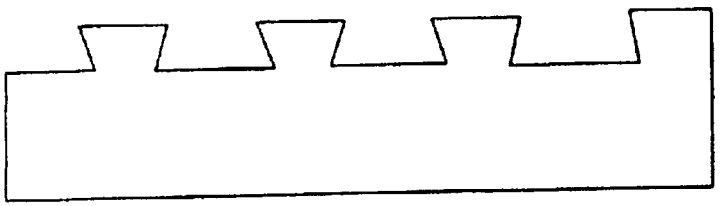
Figure 9:
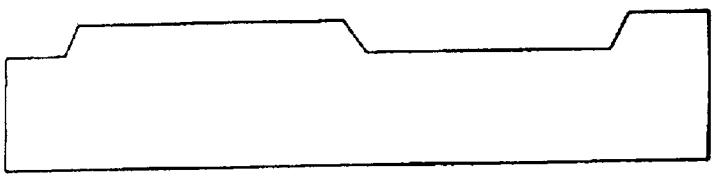
Figure 4:
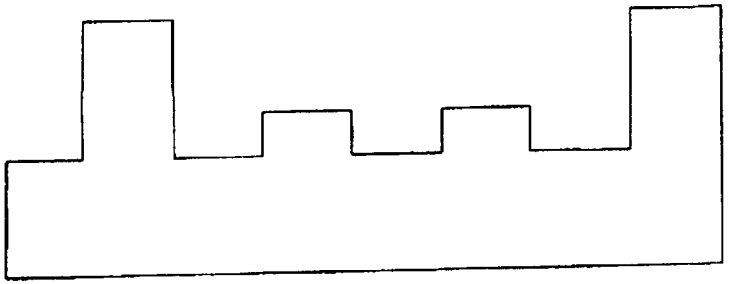
Figure 6:
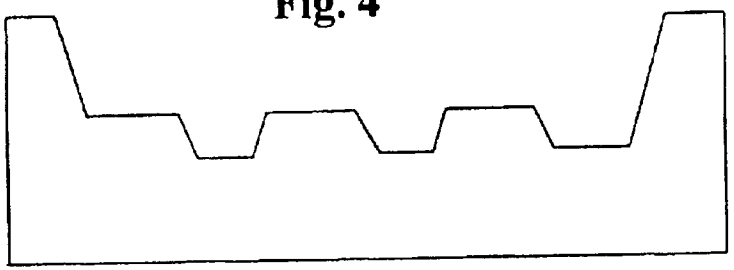
Figure 8:
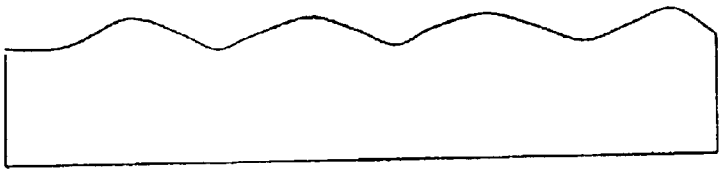

FIG. 3 illustrates the assembly of the present single unit. In FIG. 3, backer 6, is aligned with the outward bottom edges 8–11 of tabs 5 in butt portion 4 and headlap side portions 19 and 16 and is mounted under stippled top sheet 3 so that, in this embodiment, the lower margin of the backer is flush with the bottom margin of the tabs and backer 6 is exposed in the spaces between stippled top sheet tabs 5. For economy, the overall width of backer 6 is preferably less than that of the combined butt and headlap portion but is greater than the height of tabs 5 and indicia 20 so that, as shown by broken line 18, the entire upper margin of backer 6 underlays and extends a distance above tabs 5 and projections 7 extend above indicia 20 of headlap portion 3.

As modifications of the above FIG. 3, the backer strip can be positioned to extend below tabs 5 for a shadow affect and/or only backer projections 7 extended in the area above nailing indicia 20 of headlap 3.

The projections on the upper margin of the backer sheet can be of any uniform or mixed size, shape or spacing arrangement which provides increased nailing area to simultaneously attach all members of the composite shingle unit to the roof deck. Also, nailing sites in the nailing area can be marked or unmarked to accommodate various nailing patterns, e.g. chevron, random or linear patterns, within the enlarged nailing area. The enlarged nailing area of the present backer assures that nails pass through all membranes of the laminated shingle, minimize the stress at membrane penetration sites, avoids significant weight increase of the shingle unit while retaining desirable nesting properties for shingle packaging.

FIGS. 4–9 illustrate a few modifications of backer members having projections of a different configuration which are also suitable for the purpose of the present invention.

Figure 10:
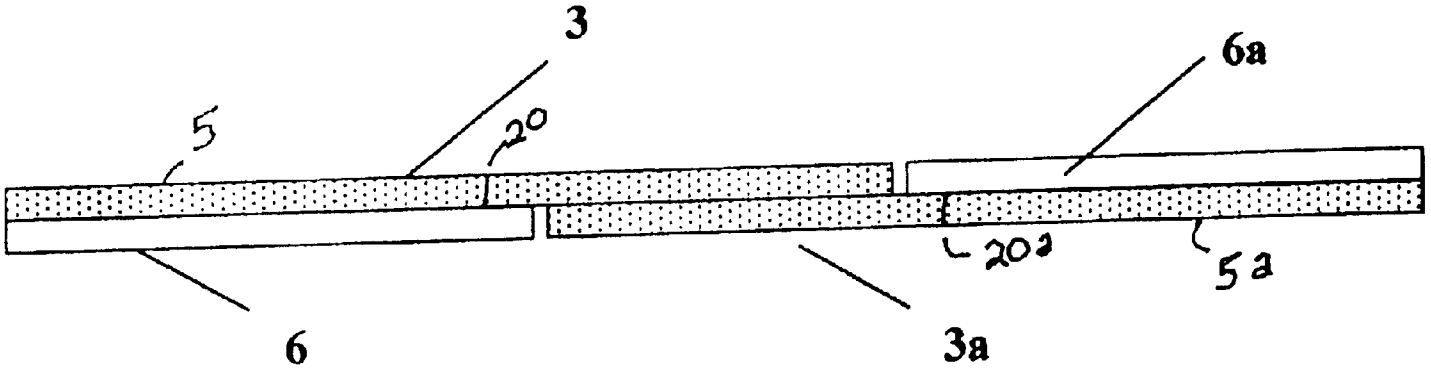
FIG. 10 is a side view of a plurality of the present shingles packaged in a preferred nesting arrangement.

In accordance with the preferred embodiment of this invention, the backer underlaying the top sheet has a thickness approximately equal to that of the top sheet and an overall width greater than that of the combined height of the top sheet tabs and nailing indicia. Although the total width of the backer can be as wide as the top sheet; it is preferred for shingle weight considerations, handling and ease of installation, that the width of the backer be not more than that of the top sheet tabs plus one half the width of the headlap portion, most preferably not more than $\frac{1}{4}^{th}$ the width of the headlap portion. For the most convenient packaging and shipment of the present shingles, the extended projections of the backer should have a dimension convenient to nesting when the shingle units are packed back to back as shown in side view FIG. 10. Although the projections on the backer strip can extend up to the top of the headlap portion of the top sheet, a backer projection height of from about 0.5 to about 5 inches is recommended.

The laminated shingles described herein can have from 2 to 8 tabs of uniform or varying shape depending from a common headlap section; although from 4 to 6 tabs are preferred.

Although composite shingles consisting of two members have been illustrated, it is to be understood that the improved backer of this invention can also be employed with roofing shingle composites having three or more members.

The present shingle units can be manufactured by conventional processes where only the cutting pattern is modified. Such a method of manufacture is shown in U.S. Pat. No. 4,233,100, the teaching of which is incorporated herein.

It is to be understood that many modifications and substitutions can be made in the above description and disclosure without departing from the scope of this invention. For example the present backers can be employed in multi-membrane siding applications or membrane attachment applications where adhesive is employed in place of nails.

What is claimed is:

1. In a composite laminated shingle unit comprising (a) a top sheet having a lower butt portion which is longitudinally divided into a plurality of spaced tabs depending from an upper undivided headlap portion having a horizontally defined nailing indicia positioned above the butt portion indicating sites for attachment of the shingle unit to a substrate and (b) an elongated backer strip underlying the tabs and lower portion of the headlap which backer strip is positioned in offset or flush position along the side edges of the top sheet; the improvement which comprises a backer strip having spaced, vertically extended projections along its top margin said projections positioned in underlying contact with said nailing indicia and laminated thereto.

2. The composite shingle of claim 1 wherein said projections of said backer strip extend above the nailing indicia of the lower headlap portion.

3. The composite shingle of claim 1 wherein the backer strip completely fills the spaces between the tabs of the top sheet.

4. The composite shingle of claim 2 wherein the bottom edge of the backer is flush with the bottom edges of the tabs of said top sheet.

5. The composite shingle of claim 2 wherein the bottom edge of the backer sheet extends below the bottom edge of the tabs of said top sheet.

6. The composite shingle of claim 1 wherein the width of the backer sheet is greater than the combined height of the tabs and nail indicia and is less than ½ the width of the headlap portion.

7. The composite shingle of claim 1 wherein said nailing indicia is defined by a line of spaced markings.

8. The composite shingle of claim 1 wherein said projections of said backer strip are of uniform height.

9. The composite shingle of claim 1 wherein said projections of said backer strip are of different heights.

10. The composite shingle of claim 9 wherein said projections at the leading and trailing edges of said backer strip are higher than any intermediate projection.

11. The composite shingle of claim 1 wherein the projections of said backer strip are of uniform shape.

12. The composite shingle of claim 1 wherein the projections of said backer strip are not uniform in shape.

13. The composite shingle of claim 1 wherein the projections of the backer strip have a height of between 0.5 and about 5 inches.

14. The composite shingle of claim 1 wherein projections of the backer strip extend between about 1 and about 3 inches above the nailing indicia.

15. The method of simultaneously producing a pair of composite laminated shingle units of claim 1 from a unitary shingle membrane which comprises:

(a) cutting the central portion of the shingle membrane to provide a matched pair of shingle top sheets having an outer headlap portion and an inner butt portion comprising a plurality of spaced tabs wherein the tabs of said pair are in abutment and are horizontally disposed across the membrane and each top sheet being marked in the respective headlap portions above the butt portions with a horizontal nailing area defined by spaced marking indicia;

(b) simultaneously cutting the membrane along the outer horizontal free edge of each headlap portion to define a pair of matching rectangular backer strips having a width greater than said butt portions of the respective top sheets and each backer strip having spaced outwardly extending projections along its outer free margin;

(c) separating the pair of top sheets and the pair of backer strips;

(d) assembling a backer strip under each top sheet in a manner such that the backer strip fills the spaces between the tabs and the projections are in contact with the nailing indicia of the top sheet to provide a pair of assembled shingle units; and (e) laminating the backer strips to the top sheets of the respective assembled units to provide a pair of composite laminated shingles.

* * * * *